United States Patent [19]

Miyata et al.

[11] 4,456,155

[45] Jun. 26, 1984

[54] AEROSOL SPRAY DEVICE

[75] Inventors: Hiroyasu Miyata; Masao Ohkita; Akinori Itoh, all of Furukawa; Shohji Minatodani, Zama, all of Japan

[73] Assignee: Alps Electric Co., Ltd., Tokyo, Japan

[21] Appl. No.: 311,062

[22] Filed: Oct. 13, 1981

[30] Foreign Application Priority Data

Oct. 14, 1980 [JP] Japan ..... 55-143430

[51] Int. Cl.[3] ..... B65D 83/14

[52] U.S. Cl. ..... 222/396; 239/308; 239/346

[58] Field of Search ..... 239/303, 308, 337, 346; 222/130, 153, 396, 397, 399

[56] References Cited

U.S. PATENT DOCUMENTS

| | | | |
|---|---|---|---|
| 1,139,353 | 5/1915 | Ellis | 222/396 |
| 1,412,321 | 4/1922 | Tate | 239/399 |
| 1,742,604 | 1/1930 | Lemoine | 239/308 |
| 1,959,815 | 5/1934 | Corcoran | 222/396 |
| 2,149,929 | 3/1939 | Plastaras | 239/303 |
| 2,514,773 | 7/1950 | Kromer | 222/396 |
| 3,069,097 | 12/1962 | Cheney | 239/303 |
| 4,174,811 | 11/1979 | Binder et al. | 239/308 |

FOREIGN PATENT DOCUMENTS

| | | | |
|---|---|---|---|
| 647573 | 8/1962 | Canada | 222/396 |
| 999454 | 1/1952 | France | 239/308 |

*Primary Examiner*—John J. Love
*Assistant Examiner*—Michael J. Forman
*Attorney, Agent, or Firm*—Guy W. Shoup; Gerard F. Dunne

[57] ABSTRACT

An aerosol spray device having a spray container charged with an agent to be sprayed, and an assembly including a bomb charged with a propellant compressed gas and a pressure regulator attached to the outlet side of the bomb. The assembly is mounted and fixed to the inside of the spray container through a packing interposed therebetween. The pressure regulator includes a piston adapted to control the flow of the gas from the bomb into the spray container through the pressure regulator. Means are provided for holding the piston in inoperative position until the aerosol spray device is actually used by the user after fabrication.

6 Claims, 5 Drawing Figures

AEROSOL SPRAY DEVICE

BACKGROUND OF THE INVENTION

The present invention relates to a construction of an aerosol spray device.

Aerosol spray devices used heretofore typically make use of freon gas as the propellant for propelling the agent in the spray container. However, there is a current tendency in many countries to restrict or forbid the use of freon gas as the propellant in an aerosaol spray device. This gives rise to a demand for an aerosol spray device having a novel construction which does not necessitate the use of a freon gas propellant.

SUMMARY OF THE INVENTION

Accordingly, an object of the invention is to provide an aerosol spray device substitutable for conventional aerosol spray devices making use of freon gas, wherein the spray container of the spray device houses a compressed gas cylinder charged with a compressed gas for use as a propellant for propelling the agent from the spray container.

The above and other objects, as well as advantageous features of the invention will become clear from the following description of the preferred embodiments taken in conjunction with the accompanying drawings.

DESCRIPTION OF THE PREFERRED EMBODIMENTS

Figure 1:
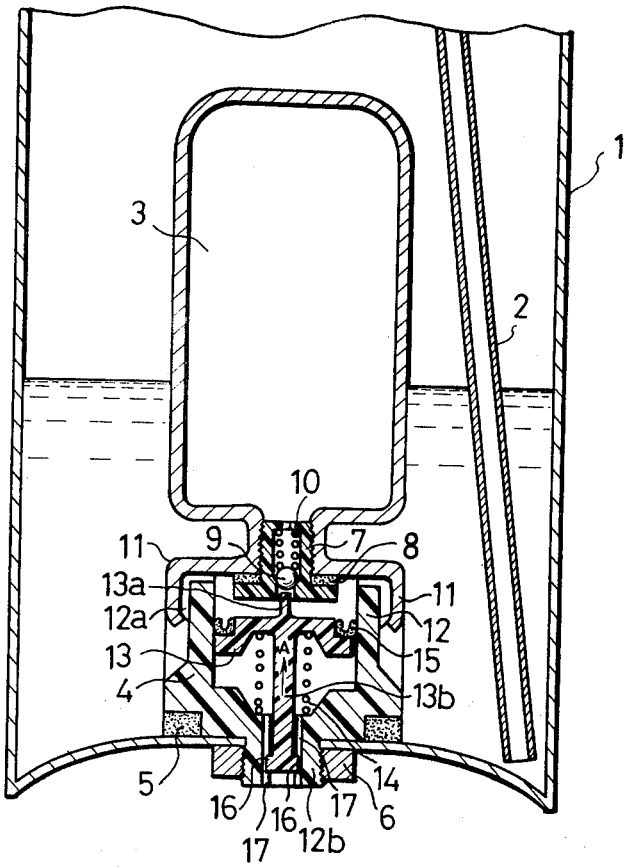
FIG. 1 is a sectional side elevational view of an essential part of an aerosol spray device in accordance with an embodiment of the invention.

Referring to the drawings showing preferred embodiments of the invention, a reference numeral 1 designates a spray cylinder the upper head portion of which has a manipulation portion (not shown) having a nozzle (not shown). This spray device has a mechanism having an intake tube 2 connected to the nozzle and adapted to permit the discharge of the agent in the spray container 1 as the manipulation portion is depressed. This mechanism, however, is not described in detail here because it is materially identical to that of conventional spray devices.

A reference numeral 3 designates a cylinder or bomb charged with nitrogen gas compressed to a pressure of about 100 Kg/cm$^2$. A pressure regulator 4 is attached to the opened end of the bomb 3. The bomb 3 together with the pressure regulator 4 is secured to the bottom of the spray container 1 by means of a nut 6 through the medium of a packing 5. A ball holding member 7 made from a plastic material is screwed into the opening of the cylinder 3 through a packing 8 interposed therebetween. The ball holding member 7 accomodates a ball 9 and a coiled spring 10 for pressing the ball 9 toward a passage port 7*a*. The pressure regulator 4 is connected to the bomb 3 by means of an arm 11. The pressure regulator 4 is composed of a cylinder 12, piston 13 and a coiled spring 14 and is adapted to regulate the pressure by the force of the spring 14.

The cylinder 12 is provided on its periphery with a mounting portion 12*a* and on its bottom with a cylindrical projection 12*b*. The piston 13 is located within the cylinder 12 and is provided at its upper end with a projection 13*a* and at its lower end with a piston rod 13*b* extending downwardly therefrom. In addition, the piston 13 is provided with a step 13*c* for receiving the packing 15 and a groove lid 13*d* for receiving one end of the coiled spring 14. A pair of projections 16,16 are formed on the peripheral surface of the lower end portion of the piston rod 13*b*. These projections 16 are adapted to slide along the guide grooves 17,17 formed at the inner side of the cylindrical projection 12*b*.

Figure 2:
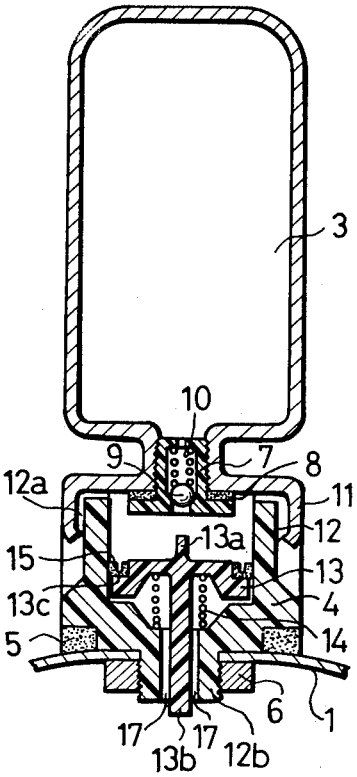
FIG. 2 is a sectional side elevational view of the aerosol spray device shown in FIG. 1 in the state in which a piston 13 is held in inoperative condition.
Figure 3:
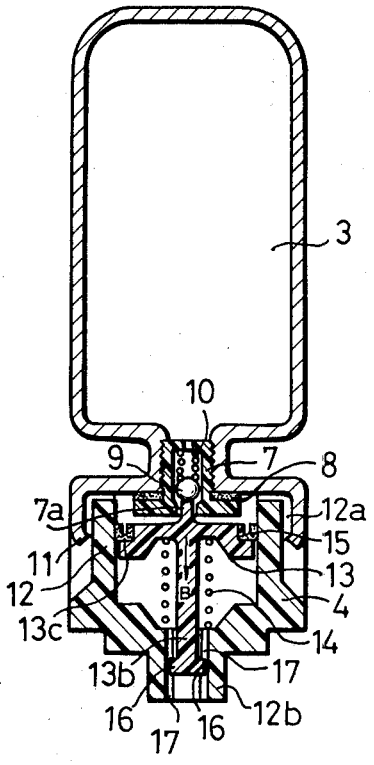
FIG. 3 is a sectional side elevational view for explaining the aerosol spray device.

The arrangement is such that, as the piston rod 13*b* is pulled downwardly against the force of the spring 14 so that the pair of projections 16,16 clear the respective guide grooves, the piston rod 13*b* may be slightly rotated to turn the projections 16,16 out from their alignment with the guide grooves 17,17. The piston 13 may thus be held in an inoperative state as shown in FIG. 2. The pressure regulator 4 is secured to the spray container 1 as the nut 6 is screwed to the thread formed on the outer periphery of the cylindrical projection 12*b* of the cylinder 12.

The aerosol spray device of the invention having the construction heretofore described is assembled in the following procedure.

First of all, the pressure regulator 4 is attached to the opening of the bomb 3 by means of the arm 11. In this state, the piston 13 of the pressure regulator 4 is placed in the position shown in FIG. 2 so that the projections 16,16 are kept out of engagement with the guide grooves 17,17, and the projection 13*a* of the piston 13 is kept out of cotact with the ball 9.

The bomb 3 and the pressure regulator 4 assembled as a unit are inserted into the head of the spray container 1, and the cylindrical projection 12*b* of the cylinder 12 of the pressure regulator 4 is received by the hole of the bottom of the spray container 1. Then, the nut 6 is tightened to fix the pressure regulator 4 to the spray container 1. A packing 8 is placed beforehand between the pressure regulator 4 and the spray container 1.

Subsequently, after charging the spray container 1 with the agent to be sprayed, a cap having the manipulation portion and the intake tube 2 is fixed to the head portion of the spray container 1 by caulking, thus completing the assembling.

The aerosol spray device of the invention is kept, before the actual use after the fabrication and delivery to the users, in such a state that the piston 13 is held in the inoperative position to prevent the gas in the bomb 3 from flowing into the spray container 1.

The aerosol spray device of the invention operates in a manner explained hereinunder. As the piston rod 13*b* is slightly rotated to bring the projections 16,16 into alignment with the guide grooves 17,17 provided on the cylinder 12, the piston 13 is moved in the direction of the arrow A by the action of the coiled spring 14, so that the projection 13*a* pushes up the ball 9 upwardly to move the latter. In consequence, a gap is formed between the ball holding member 7 and the ball 9 so that the gas in the bomb 3 is allowed to flow into the cylinder 12. Since the interior of the pressure regulator is communicated with the space in the spray container 1, the internal pressure of the latter is gradually increased and, as a predetermined pressure is reached in the spray container 1, the piston 13 is moved in the direction of arrow B to attain a balance between the force exerted by the coiled spring 14 and the force generated by the compressed gas.

In consequence, the projection 13*a* stops to press the ball 9 so that the latter blocks the passage port to stop the flow of the gas into the spray container 1.

Then, as the manipulation portion is depressed, the agent in the spray container 1 is discharged from the latter together with the gas acting as the propellant gas. As a result of the discharge of the gas, the internal pressure of the spray container 1 is lowered which in turn causes a reduction of the pressure in the cylinder 12. In consequence, the piston 13 is moved in the direction of the arrow A by the action of the coiled spring 14 so that the projection 13*a* serves to lift the ball 9. In consequence, the gas in the bomb 3 flows into the cylinder 12 and the spray container 1 through the gap formed between the ball 9 and the ball holding member 7 until the balance is attained between the forces acting on the piston, i.e. the force exerted by the coiled spring 14 and the force generated by the pressure. This operation is repeated to permit the spray of the agent from the aerosol spray device.

Figure 4:
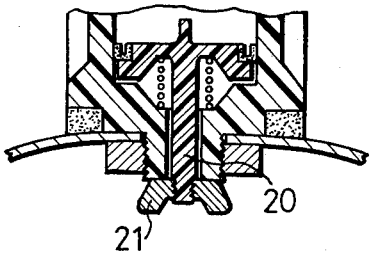
FIGS. 4 and 5 are sectional side elevational view of different embodiments.
Figure 5:
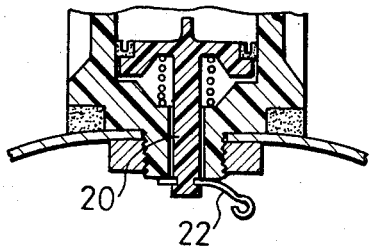

In the described embodiment, the projections 16,16 are formed on the piston rod 13*b* to act as means for holding the piston 13 in inoperative position. This, however, is not exclusive and the piston 13 may be held in the inoperative position by means of a butterfly nut 21 screwed to the end of the piston rod 20 as shown in FIG. 4. Alternatively, the piston may be held in the inoperative position by a stopper member retained by the end of the piston rod 20 as shown in FIG. 5.

As has been described, the aerosol spray device of the invention does not make use of freon gas which has been used in the conventional aerosol spray devices, but, insteadly, a bomb charged with a propellant compressed gas is accommodated by the spray container. The flow of the gas from the bomb into the spray container is regulated by a piston of the pressure regulator. In addition, means are provided for holding the piston in inoperative state to prevent the gas from being released from the bomb into the spray container until the aerosol spray device is actually used.

It is, therefore, possible to avoid the leak of the propellant gas however long the aerosol spray device is kept out of use. In addition, the aerosol spray device of the invention can be fabricated by a simple machine in such a state that no pressure is acting inside the spray container so that the production cost is economically reduced.

What is claimed is:

1. In an aerosol device for producing an aerosol spray of an agent contained within a container; an assembly for raising the pressure within said container to a predetermined level; said assembly including a cylinder charged with a compressed gas and having an outlet closed by a valve, a pressure regulator attached to said cylinder, said pressure regulator having means including a piston movable in response to lowering of the pressure within said container for opening said valve to release compressed gas from said cylinder to raise the pressure back to said predetermined level, means for mounting said assembly in fluid-tight relation over an opening in a wall portion of said container; and de-activating means secured to said piston for holding it in a position to maintain said valve in a state closing said outlet of said cylinder until the pressure within said container is to be raised to said predetermined level, said de-activating means including a piston rod connected to said piston and adapted to extend through said opening, said piston rod and said opening having axial projections and axial grooves formed respectively thereon so that said piston rod may be rotated to bring said projections out of alignment with said grooves to hold it in said position maintaining said valve in its state closing said outlet and further rotated to bring said projections into alignment with said grooves to allow said piston to move according to the level of pressure within said container.

2. An assembly according to claim 1, said pressure regulator including a cylinder receiving said piston and a spring urging said piston into its position opening said valve.

3. In an aerosol device for producing an aerosol spray of an agnet contained within a container; an assembly for raising the pressure within said container to a predetermined level; said assembly including a cylinder charged with a compressed gas and having an outlet closed by a valve, a pressure regulator attached to said cylinder, said pressure regulator having means including a piston movable in response to lowering of the pressure within said container for opening said valve to release compressed gas from said cylinder to raise the pressure back to said predetermined level, means for mounting said assembly in fluid-tight relation over an opening in a wall portion of said container; and de-activating means secured to said piston for holding it in a position to maintain said valve in a state closing said outlet of said cylinder until the pressure within said container is to be raised to said predetermined level, said de-activating means including a piston rod connected to said piston and adapted to extend through said opening, said piston rod having an end portion adapted to be withdrawn from said opening and held in position by a nut threaded thereon to hold said piston in position maintaining said valve in its state closing said outlet and thereafter said nut may be removed to allow said piston to move according to the level of pressure within said container.

4. An assembly according to claim 3, said pressure regulator including a cylinder receiving said piston and a spring urging said piston into its position opening said valve.

5. In an aerosol device for producing an aerosol spray of an agent contained within a container; an assembly for raising the pressure within said container to a predetermined level; said assembly including a cylinder charged with a compressed gas and having an outlet closed by a valve, a pressure regulator attached to said cylinder, said pressure regulator having means including a piston movable in response to lowering of the pressure within said container for opening said valve to release compressed gas from said cylinder to raise the pressure back to said predetermined leve, means for mounting said assembly in fluid-tight relation over an opening in a wall portion of said container, and de-activating means secured to said piston for holding it in a position to maintain said valve in a state closing said outlet of said cylinder until the pressure within said container is to be raised to said predetermined level, said de-activating means including a piston rod connected to said piston and adapted to extend through said opening, said piston rod having an end portion adapted to be withdrawn from said opening and held in position by a detachable stopper held thereon to hold said piston in position maintaining said valve in its state closing said outlet and thereafter said stopper may be removed to allow said piston to move according to the level of pressure within said container.

6. An assembly according to claim 5, said pressure regulator including a cylinder receiving said piston and a spring urging said piston into its position opening said valve.

* * * * *